United States Patent [19]

Sidera

[11] Patent Number: 4,833,804

[45] Date of Patent: May 30, 1989

[54] DISPLAY DEVICE FOR IMAGES BROKEN UP INTO STRIPS

[76] Inventor: Luis C. J. Sidera, 10 rue Jules Ferry, les Clayes sous Bois, France, 78340

[21] Appl. No.: 50,712

[22] Filed: May 14, 1987

[30] Foreign Application Priority Data

May 15, 1986 [FR] France ..... 86 06971

[51] Int. Cl.[4] ..... G09F 11/32

[52] U.S. Cl. ..... 40/512; 40/476

[58] Field of Search ..... 40/475, 476, 508, 509, 40/511, 512, 524, 526, 530

[56] References Cited

U.S. PATENT DOCUMENTS

| | | | |
|---|---|---|---|
| 473,128 | 11/1903 | Woodbridge | 40/476 |
| 941,012 | 11/1909 | Collins | 40/476 |
| 1,047,904 | 12/1912 | Bienhoff | 40/476 X |
| 1,050,276 | 3/1913 | Harvey | 40/512 X |
| 1,213,272 | 1/1917 | Sarver | 40/511 |
| 3,080,668 | 3/1963 | Neali | 40/476 |
| 4,006,545 | 2/1977 | Mathews | 40/36 |

FOREIGN PATENT DOCUMENTS

| | | | |
|---|---|---|---|
| 328405 | 11/1920 | Fed. Rep. of Germany | 40/512 |
| 139966 | 8/1930 | Switzerland . | |
| 16346 | of 1911 | United Kingdom . | |
| 510943 | 12/1939 | United Kingdom . | |

*Primary Examiner*—A. Michael Chambers
*Assistant Examiner*—John C. Fox
*Attorney, Agent, or Firm*—Darby & Darby

[57] ABSTRACT

Device for the sequential display of images broken up in the form of groups of strips comprising a drive motor and means for cyclically displaying a succession of images. The strips are mounted on movable pallets (4, 57), independent of each other; the pallets (4, 57) are regrouped together according to the relative position of the strip which they carry in the reconstituted image, each group of pallets (4, 57) is guided so that each pallet (4, 57) remains independent of the others, and is guided along a looped track (9, 41).

7 Claims, 5 Drawing Sheets

4
4
19
10
14
15
8
25
26
4
13
24
7
11
12
21
17
9
24
27
28
33
32
31
18
16

6
4
5
8
6
7
8

DISPLAY DEVICE FOR IMAGES BROKEN UP INTO STRIPS

The invention concerns devices for sequential display of images broken up into strips, used mainly for advertising.

In the known devices of this kind, one example of which is discribed in French Pat. No. 2,029,479, the images, each broken up into a group of strips, are fixed in groups on supports associated with one or more cams driven by the shift of an electric motor which drives said supports in a reciprocating movement. The various groups of stripes are interleaved and the profile of the cams is adapted to sucessively bring into exposed position the groups of stripes constituting images. The whole is mounted in a frame contained in a closed box with a window behind which the reconstituted images appear sucessively.

One of the main disadvantages of the known devices results from the fact that the stripes constituting the parts of images are integral with the supports which impel them.

It is necessary, therefore, when an image is to be replaced, to set down all supports, to separate the group of stripes of the image to be replaced from the other groups, then to position the new stripes on the corresponding support, while maintaining the order of interfoliation of the new strips with those of the other groups.

The changing of images in the known devices thus necessitates the invention of specialized personnel and makes the device unavailable for a relatively long time. It is practically impossible for this replacement to be carried out by the user himself.

It is the object of the invention to provide a device for sequential display of images broken up into groups of strips, in which the replacement of the images is simplfied and faster.

Another object of the invention is to provide a device of the aforesaid type which can operate continuously for a long time, without causing deteriorations of the images or jamming, let alone blocking , or the device, produced by faulty interleaving of the strips of the various groups.

According to the invention, one obtains these results because the strips are mounted on moveable pallets independent of each other, which pallets are grouped together according to the relative position of the strip which they carry in the reconstituted image. Each group is guided by means disposed on either side of each pallet, along a track, (each pallet remaining independent of the other pallets constituting the same group), in a loop.

The device as a whole has as many levels of tracks as there are strips for reconstituting an image.

The different groups of pallets and their respective tracks are arranged in such a way that, in exposed position, the superposed strips of the various groups connect together to reform the complete image, the connecting lines being practically invisible.

The assembly is lodged in a box provided with a window behind which the reconstituted images are displayed.

Compared with the known devices, the invention affords numerous advantages.

Due to the fact that the pallets are no longer interleaved, but taken along individually up to their exposed position, the replacement of a single pallet, hence of the portion of image that it carries, can take place individually, in a very simple manner, without requiring specialized personnel.

On the other hand, as the pallets are in contact with each other only over a small portion of their course and along an edge bearing against their back face, the strips themselves are not subjected to friction and the wear of the images is very substantially reduced.

According to a first form of realization, the looped course of the track of the groups of pallets comprises a portion for elevation of each pallet individually up to a higher level, a horizontal portion in which the pallets pile up and exert on each other a thrust which, in cooperation with a stop intergral with the box and disposed in front of the tracks, tends to bring the first pallet of the row into a vertical position of exposition, and an oblique portion in which the pallet just displayed falls back individually by its own weight to the low level of the elevation portion.

An elevator controlled by a connecting rod-crank assembly driven by an electric motor cyclically receives each pallet at the low point of the elevation portion and raises it to the level of the horizontal upper portion of the track.

A shutter controlled by a cam driven preferably by the same electric motor temperarily blocks the pallets exposed in display position.

The tracks have, on their front, openings intended to permit removing and positionaing the pallets individually.

According to a second form of realization, the looped course comprises a portion for elevation of each pallet individually up to an upper level, a first descent portion parallel to the former and situated below the latter, in which each pallet is accompanied individually, a second descent portion in which the pallets pile up by gravity one behind the other and exert on each other a thrust which in cooperation with a movable stop tends to raise the first pallet of the row up again into vertical position and to bring it into display position after oblteration of the movable stop.

A first endless chain, the links of which carry at regular intervals a finger pointing outward, assures the individual transport of the pallets along the elevation portion of the looped circuit. A second endless chain, similar to the first and whose links also carry at regular intervals fingers pointing outward, accompanies the individual descent of each pallet along the first descent portion.

Other characteristics and advantages of the invention will become evident from the description that follows, or a non-limiting embodiment example of the invention, with reference to the annexed drawings in which.

Figures 2, 3:
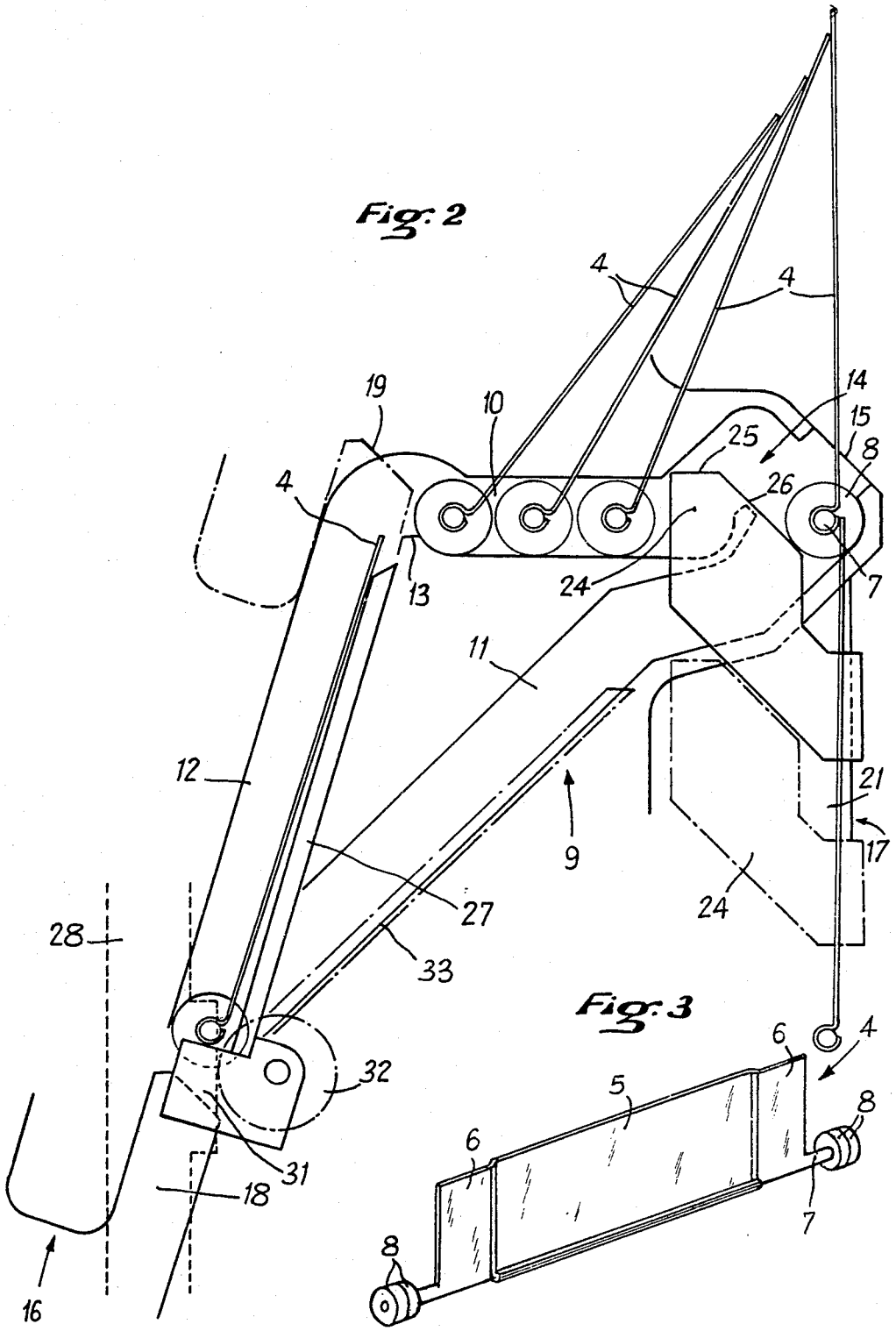
FIG. 2 is a partial schematic sectional side view of a track with a group of pallets according to a first form of realization of the invention.
FIG. 3 is a perspective view of a pellet intended to cooperate with the track of FIG. 2.
Figure 4A:
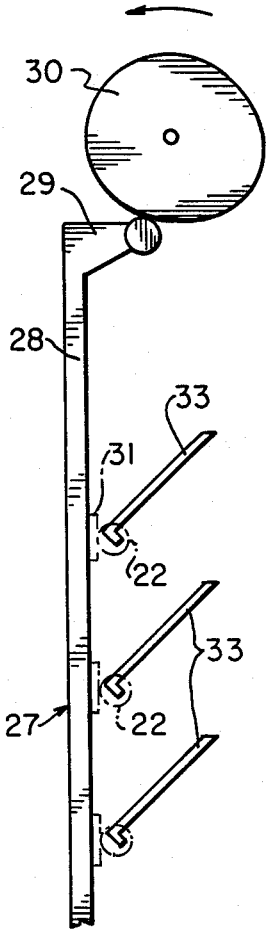
Figure 4B:
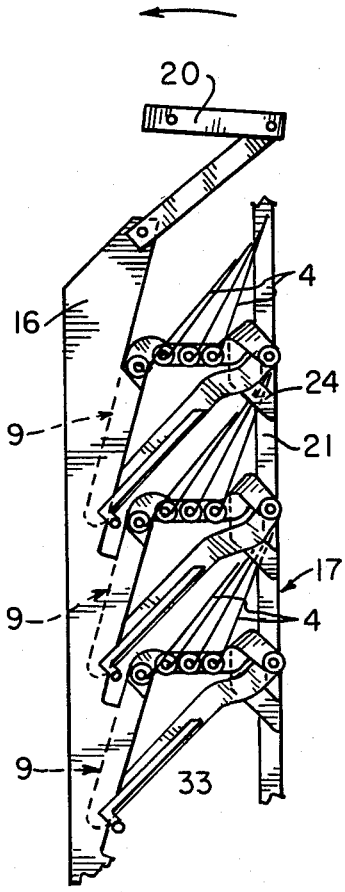
Figure 4C:
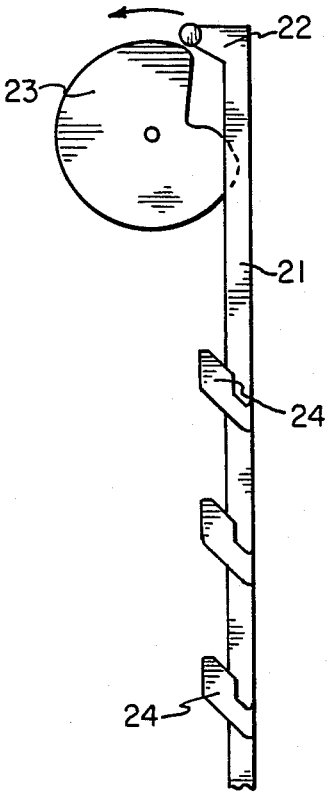
Figure 5:
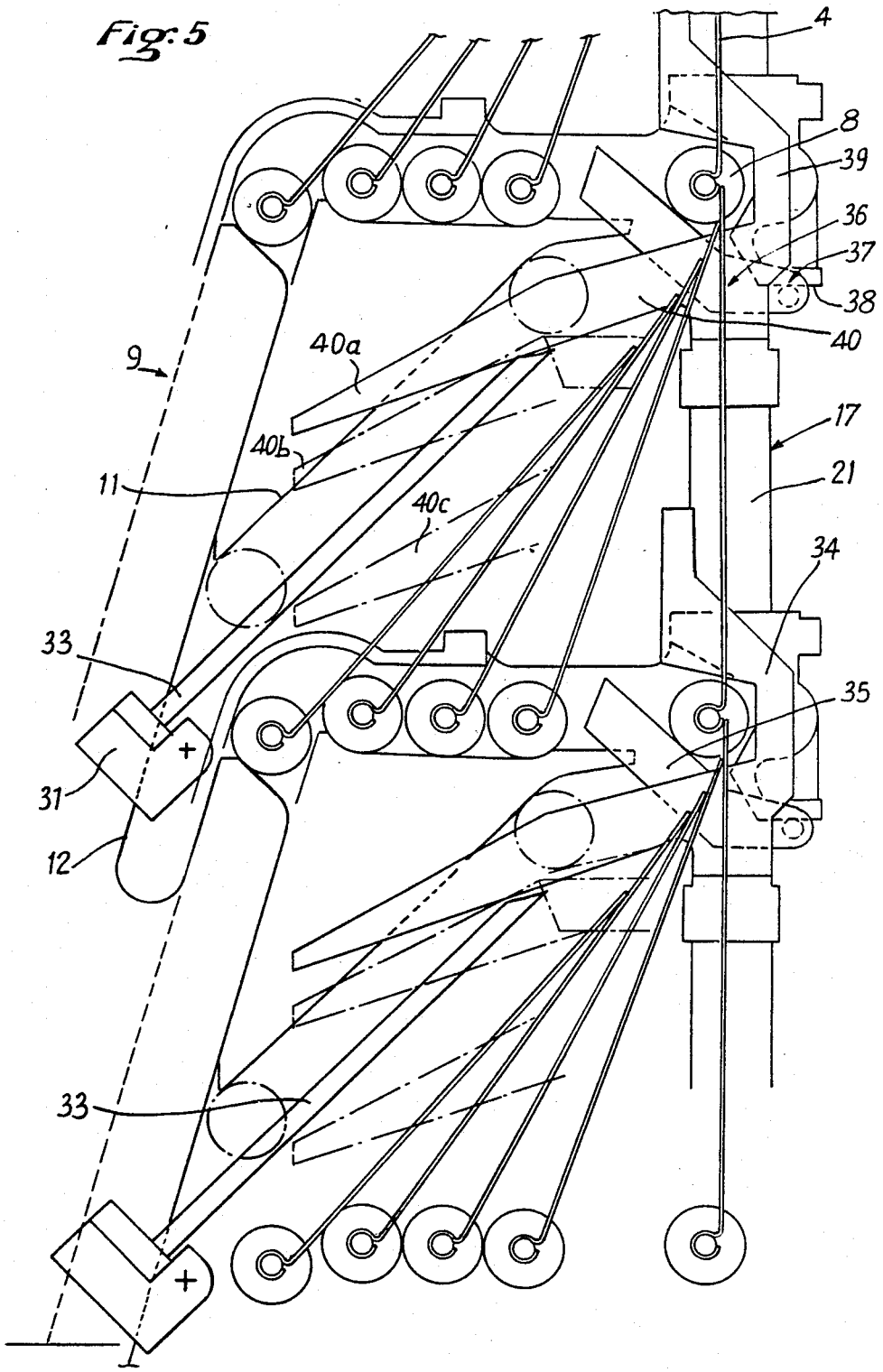

FIG. 4, 4A, 4B, and 4C are a partial schematic sectional side views respectively of the rocking lever, the track with pallets and the shutter; of one stage of an image display cycle with a device according to FIGS. 2 and 3, the rocking lever and the shutter being shown separately in FIGS. 4A and 4C respectively;

FIG. 5 is a view, similar to that of FIG. 2, of another form of realization improved so as to eliminate the operation noises.

Figures 6, 7:
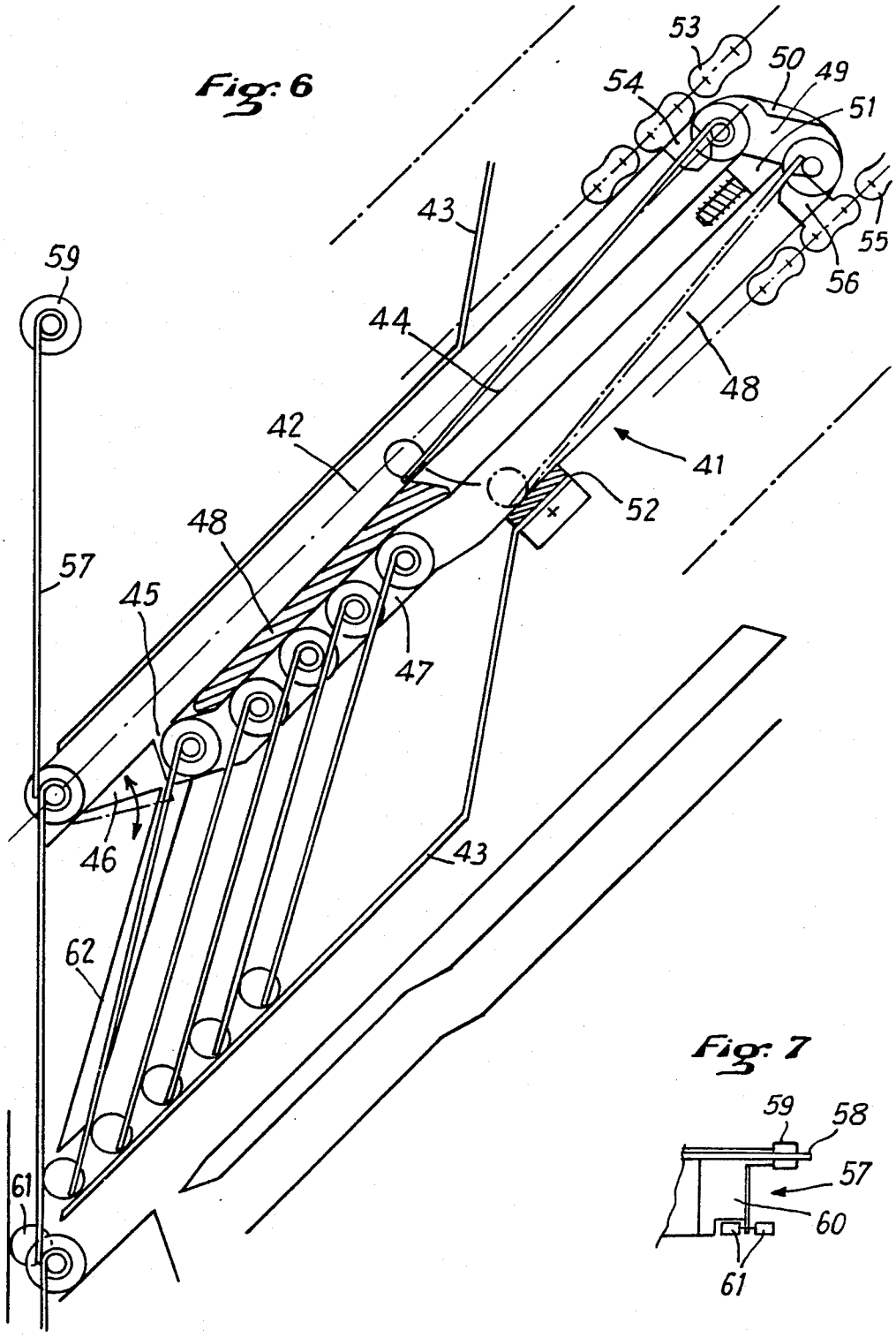

FIG. 6 is a partial schematic sectional side view of a track according to a second form of realization of the invention;

FIG. 7 is a partial view in elevation of a pallet intended to cooperate with the track of FIG. 6.

Figure 1:
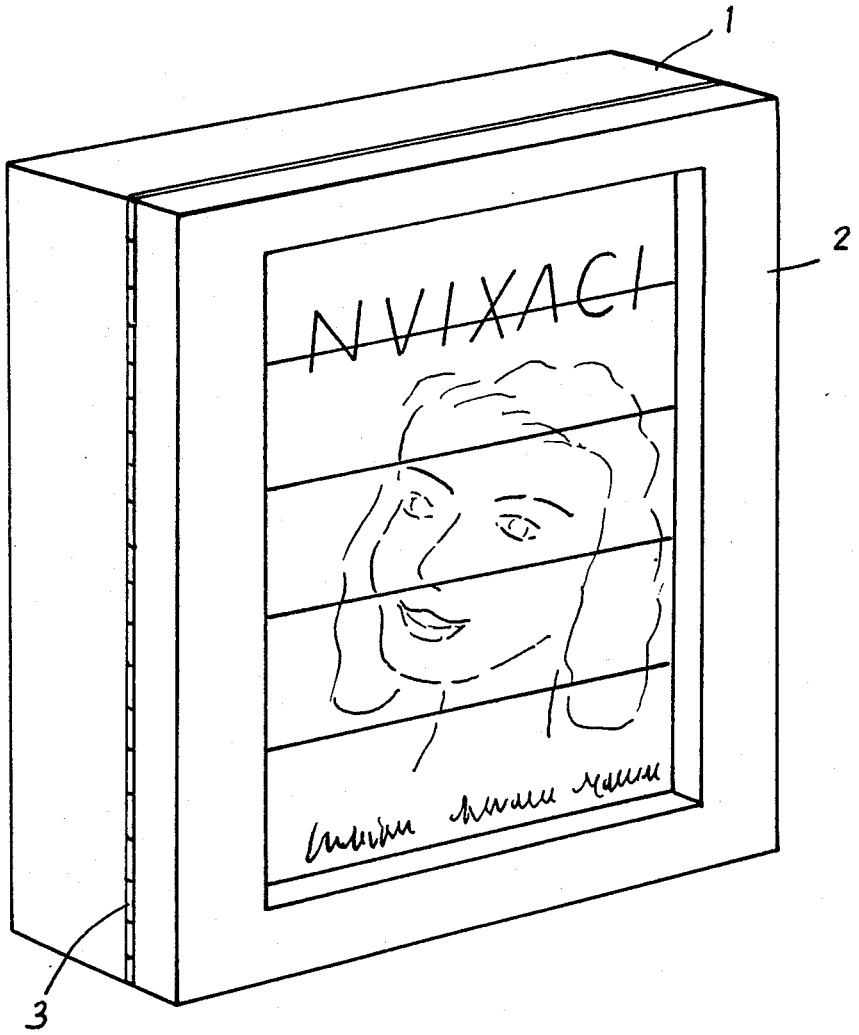
FIG. 1 is a general schematic view of a box comprising a display device according to the invention.

Seen in FIG. 1, the box 1, which encloses the device, is a parallelepipedon with a glass front 2, articulated to the rest of the box by a hinge 3. The dimensions of the glass pane determine those of the images to be displayed.

The images are, in known manner, cut into strips. These strips are mounted on pallets 4.

Each pallet 4 consists, as is seen in FIG. 3, of a plate 4, of substantially rectangular form, with projecting wings 6 on either side of a bottom 5.

The base of plate 4 is partially wound around a rod 7, protruding on either side of the wings 6 and on the ends of which twos pairs of rollers 8, independent of each other, are mounted for free rotation.

On the bottom 5 of the pallet are disposed fastening means, for example adhesive ones, intended to assure the hold of a portion of image, the dimensions of which coincide with those of the bottom.

The wings 6 on either side of the strip are intended to cooperate with stop means, not shown, carried by the box 1, on either side of the image expsition zone, said stop means preventing the pallets 4 from rocking forward, beyond their vertical position of exposition.

The preferred salient arrangement of the wings 6 assures also the protection of the image strips, by keeping them recessed, so that all along the course of the pallets said strips do not rub against other parts of the device, all contacts taking place by the wings 6.

This protection of the strips is assured also along their lower edge, by the fact that the base of the bottom 5 of the pallet 4 is wound only partially around the rod 7. Thus, the lower edge of the pallet wound around the rod cannot come in contact with the lower edge of the strip.

The rollers 8 are intended to cooperate with two symmetrical tracks 9, mounted in box 1, perpendicularly to the plane of the exposed image.

The design of a track 9 is visual in detail in FIG. 2. It is seen that the design is of substantially triangular form, with a substantially horizontal upper portion 10, an oblique front portion 11, and a likewise oblique rear portion 12.

The width of the track 9 is substantially equal to the diameter of the rollers 8.

At the connecting point between the rear portion 12 and the upper portion 10, the lower edge of the track has a projection 13 which forms an anti-return stop, preventing the pallet just raised from accidently falling backwardly.

The passage between the front part of the upper portion 10 and the oblique front portion 11 forms a hairpin bend 14.

At the top of this bend 14, the upper edge of the track has an opening 15, of sufficient dimensions to let pass the rollers 8.

When the above described stop means are removed, the pallets 4 can very easily be removed or replaced selectively one by one, by disengaging the rollers 8 from the tracks 9 through the openings 15.

Preferably, the stop means consist of at least one rod disposed substantially vertically in the box 1, in the immediate vicinity of the image exposition plane, at the level of one of the wings of the pallets 4. Said rod is preferably mounted in a removable manner in box 1.

Immediately after the bend 14, the oblique front portion 11 is deflected backwardly, as is seen in FIG. 2, and then it extends straight until it connects with the base of the obliwue rear portion 12.

As stated before, in each track 9 a group of pallets 4 is introduced, on the bottom of which are fixed the strips of the various images which, in exposed position, must be displaced at the same height in the box.

Thus, in contrast to the known devices, the strips intended to form one and the same image are not assembled on a common support and then interleaved with the strips of the other images mounted on other supports.

According to the invention, each portion of the image carries out an independent course in a track which itself is common with the strips of the other images that have the same relative position as it, when displayed.

Hence, to be able to display a complete image, the device comprises as many levels of pallets and of juxtaposed tracks as there are strips in one and the same image.

Thus, the number of images that one can display with the device according to the invention depends only on the length of the horizontal upper portion 10 of the track 9, for a given width of said path.

In FIG. 2 are shown also, very schematically and partically: the elevator 16 and the shutter 17 which, in combination with the pallets 4 and the tracks 9, assure the displacement of said pallets and their hold in exposed position.

The elevator 16 consists of a bar for oblique displacement extending over practically the full height of box 1 and its upper end is articulated on a connecting rod-crank assembly 20, driven by an electric motor not shown, fixed at the upper port of the box.

Thus, the bar of the elevator 16, guided in the oblique rear portion 12 of the track 9, is urged in a cyclic reciprocating movement, the stroke of which is substantially equal to the height of the rear portion 12.

At the level of each track 9, the bar of the elevator 10 carries a finger 18, disposed obliquely along the same angle as the rear portion 12 of the track, with which it cooperates and the upper edge of which forms an oblique bearing in the opposite direction. The reciprocating movement of the bar causes the finger 18 to rise and fall cyclically between a low point, situated at the level of the connection between the oblique portions 11 and 12 of the track 9 (shown as a solid line in FIG. 2), and a high point, situated slightly above the connection of the rear portion 12 with the upper portion 10 of the track (shown in dotted lines in FIG. 2).

During its ascending its ascending movement, the finger 18 acts, by its oblique bearing surface 19, on the inner roller 8 of the pallet 4, which has just fallen back to the low point and pushes said pallet upward.

At the top of the excursion of the elevator 16, the inner roller disengages by rolling on the oblique bearing 19, while the outer roller rolls against the upper part of the track until it abuts against the rollers of the proceding pallet.

At the time of this passage to the high point, two rollers roll in opposite direction. This arrangement of two juxtaposed rollers freely rotating relatively to each other permits avoiding the risks of jamming or blocking at the points of connection of the tracks.

As shown in the figures in this example of realization, the bottom 5 and the wings 6 of a pallet 4 are, during their entire travel, always above the rod 7 carrying the rollers 8.

During their ascent, the pallets 4 adopt an inclination substantially parallel to portion 12 of the track 9.

Thus, when they are discharged onto the horizontal portion 10 and come to rest by their upper edge against the back of the proceding pallet, they exert a torque which tends to produce the vertical erection of the first pallet of the row, the wings 6 of which, as has been said before, abut on the vertical bar forming a stop.

As it passes ther step 13, the pallet 4, which is discharged on the portion 10 of the track, pushes the preceding pallets back until the one which is directly behind the exposed pallet presents itself above the plate 24 of the shutter, to be described below.

In front of the tracks, a shutter 17 cyclically occludes the two arms of bend 14 after the passage of a pallet 4, and blocks said pallet in exposed position for a predetermined length of time.

The shutter 17 consists of a vertical bar 21, extending over pratically the full height of the box, the upper end 22 of which cooperates with a cam 23, driven in rotation by the electric motor. At its base, the bar 21 is equiped with elastic return means, such as a spring.

The shutter 17 is arranged in the immediate vicinity of the front part of the tracks 9 and parallel to said paths.

Plates 24 are mounted on the bar 21. There is one plate 24 per level of track 9.

As is seen in FIG. 2, the excursion of the shutter 17 is such that the plates 24 pass cyclically from a service position (shown as a solid line) in which they occlude the two branches of the bend 14, to an inactive position (shown in dotted lines), in which they disengage said bend.

The plate 24 comprises two active edges 25 and 26, intended to cooperate with the rollers 8 during passage of the pallets 4 in the bend 14 of the track. The plates 24 are arranged on the bar 21 in such a way that the edge 25 is parallel to the upper edge of the portion 10 of the track and that the edge 26 is parallel to the bottom of the bend 14 that has the opening 15.

Thus, during passage of a pallet in the bend 14, the rollers 8 are acted upon by the edge 25 which, in combination with the ascending movement of the bar 21, pushes the roller back into the bottom of the first branch of the bend 14, and then the rollers 8 roll on the edge 26 up to the level of the second branch of the bend, where they are blocked as long as the bar 21 has not yet started its descending movement.

In this position, the corresponding pallet is displayed. It is kept vertical by the step rods described before, which cooperate with the wings 6 of the pallet and by the support of the following pallets against the rear face of its bottom, as is seen in FIG. 2.

The descent of the shutter 17 progressively frees the lower branch of the bend 14, and the rollers 8 can then engage in the oblique front portion 11 of the track, to the low point where the pallet drops again under its own weight.

During this downward movement the pallet is prevented from rocking below its rod 7 by the previously described stop rods.

In the example represented, a rocker device 27 has been provided, intended for erecting the pallet 4 so that it will adopt the oblique position parallel to the portion 12 of the track.

The rocker 27 consists of a bar 28, the upper part 29 of which cooperates with a cam 30, driven in rotation by the motor. Bar 30 carries a series of rack portions 31 (one per level of track), arranged substantially at the level of the low points of said tracks. On one rack portion engages a pinion 32, integral with a shaft on which is fastened also a finger 33.

The rocker is arranged in the box in such a way that the fingers 33 act on the wings 6 of the pallets 4. As in the case of the shutter 17, the bar 26 of the rocker is equipped at its base with elastic return means.

In the example represented, the rocking lever 27 is used to raise the pallets into an oblique position parallel to that of the elevation portion 12 of the track.

According to a variant form not shown, this raising can be carried out automatically if the front oblique portion 11 of the track connected with the rear oblique portion 12 sligfhtly above the bottom of said rear portion and if slides are disposed at the point of connection between these two portions and cooperate with the wings of the pallets to operate the raising when the pallet falls to the bottom of the rear portion 12 of the track.

Only one side of the device has been described, but it is understood that, as the pallets are equipped with rollers on both their sides, the box has a symmetrical construction combining several levels of tracks, an elevator, and a shutter on each side.

On the other hand, it is not necessary to provide two stop rods cooperating with wings 6 of the pallets along the display face; a single rod suffices, and in this case replacement of the pallets is faster.

According to another variant form not shown, the track has a perfectly triangular outer contour. The hairpin bend 14 is replaced by an angular summit. The lower edge of portion 10 of the track slopes very slightly forward and ends in a notch whose function it is to block the pallet situated immediately behind the exposed pallet, as long as the latter is not disengaged. The upper edge of the track consists of a removable flexible blade forming a spring. The plate of the shutter has a single oblique upper edge. Said edge is topped by a hook which seizes the top of the roller of the exposed pallet so as to assure in a safe manner the starting of the downward release of the corresponding pallet. In this variant, the pallets are replaced by removing the flexible blade.

In the embodiment just described with reference to FIG. 1 to 4C, the pallets 4, having been liberated by deletion of the shutter 17, drop under their own weight to the low point of the track 9, along the oblique portion of said track.

From this results a repetition of shocks creating undesirable noises.

The embodiment shown schematically in FIG. 5 aims to resolve this problem by providing on the shutter holding means of the descending movement of the rollers of the pallets on at least the greater part of the oblique portion of the track. In addition, with this varient one obtains a positive drive of the rollers for the start of the descending movement of the pallets along position 11 of the track.

In FIG. 5, the parts corresponding to those of FIG. 2 have the same reference numbers.

Compared with the preceding example, the main modification concerns the locking finger 24 which, instead of being a single plate fixed on rod 21 of the shutter 17, consists of a first finger 34, fixed on rod 21, and directly obliquely backward and downward, cooperating with a second finger 35 mounted to pivot about an axle 36 integral with the finger 34 and equipped with a stop 37 cooperating with a protuberance 38 of the track 9 to cyclically cause the raising and lowering of the finger 35.

As is seen in FIG. 5, the rocking finger 35 is shown only in high position whereas the guide finger 34 is shown in solid lines in its high position and partially in dotted lines in various positions during its descent along portion 11 of track 9.

The guide finger 34 has a front part 39 forming a seating for a roller 8 of the exposed pallet 41, this part 39 is prolonged at its base by a ramp 40 sloping downward and backward.

The inclination and length of the ramp 40 are chosen so that it progressively disengages the oblique part 11 of the track 9 during the descent of rod 21 of the shutter 17.

The intermediate and final positions of the end of ramp 40 are schematically represented by the dotted lines 40*a*, 40*b*, and 40*c* in FIG. 5.

When rod 21 of shutter 17 is in high position, as shown in FIG. 5, the rocking finger 35 has pivoted about its axle 36 under the effect of the cooperation of its stop 37 with the protuberance 38 of the track 9, so that it blocks the roller 8 of the exposed pallet 4 in its seating of finger 34 and at the same time occludes the part 10 of the track to prevent the rollers 8 of the following pallets from coming in contact with one of the exposed pallet.

During the descent of the rod 21 when stop 37 disengages from the protuberance 38, the finger 35 slowly swings downward accompanying the roller 8 until it rests on the ramp 40 which itself starts and then accompanies the descending movement of said roller along the portion 11 of the track.

When roller 8 leaves the end of ramp 40 (position 40c), the distance which separates it from the bottom of part 11 of the track is so small that the rest of the excursion takes place practically without noise.

According to another advantageous variant form also shown in FIG. 5, the opening 15 in the track 9, intended to permit the replacement of the pallets 4, is situated, not in the passage between the upper horizontal part 10 and the oblique part 11 of the track, but in the top of the horizontal part 10.

Any risk of accidental disengagement of a pallet 4 is thus avoided

According to another form of realization shown in FIG. 6 and 7, the looped course of the tracks is, instead of being substantially triangular, of a general flattened oval form and arranged obliquely. As to the pallets, they are no longer carried by a lower rod equiped with rollers cooperating with the tracks, but suspended on an upper rod carrying rollers cooperating with the tracks while their lower edge is equipped with pairs of small rollers.

The entrainment of the pallets is no longer effected by bars urged by cams, but by two chains disposed on either side of the track and some links of which are equipped with fingers directed outwardly.

FIG. 6 shows schematically a track according to this example of realization.

It comprises a substantially oblique upper portion 42, the ceiling of which is defined by a plate 43 raised at its back end. The floor 44 of this upper part has near its front part an opening 45 occluded by a rocker 46 and connecting with the second part 47 of the lower descending portion of the pallets. The floor 44 further comprises a projection part 48, which extends substantially over the full length of the second part 47.

At its upper end, part 42 connects with the first part 48 of the descending portion by a bend 49, the ceiling of which has a projection 50 cooperating with a shutter 51. Near the front end of the first part 48 ends the raised end of the plate 43 forming the ceiling of the track of a group of lower pallets. This end carries a shock absorbing block 52.

The passage between the back part 48 and the front part 47 of the descending portion of the track 41 forms a slight elevation of the level of the front part 47 relative to that of the back part 48.

Above the ceiling of the upper portion 42 an endless chain 53 is disposed, at least one link of which carries a finger 54 directed outwardly; in a similar manner, below the upper part 48 of the descending portion a second endless chain 55 is disposed, at least one link of which is equipped with a finger 56 directed outwardly.

As is seen in FIG. 7, the pallet 57 intended to cooperate with the looped course thereabove differs from the one previously described in relation to the first form of realization in that instead of being carried by its base, it is suspended from its summit. Its upper rod 58 carries only a single roller 59 at each end instead of two.

Futhermore, the base of the projecting wings 60 of each pallet 57 carries a pair of additional rollers 61. The outer roller is recessed relative to the roller 59 carried by the rod 58.

As the construction is symmetrical, there is for each group of pallets carrying the strips a track 41 and a pair of chains 53, 55 on each side of the device.

The unit operates as follows.

From the display position of a pallet 57, the finger 54 of a link of the upper chain 53 acts on the upper rod 58 of the pallet and takes it along toward the upper end of the portion 42 of the track. The rocking lever 46 is in active position, thereby closing the communication with the portion 47.

During this entrainment, the lower rollers 61 roll over the oblique projection 62, with the result of progressively bringing the pallet into a substantially horizontal position.

While the movement continues, the pallet is held in this position owing to the projection 48. When the roller 59 reaches the entrance of the bend 49, the bottom of the pallet abuts against the shock absorption block 52.

The shutter 51 forms the passage of the roller 59 until a finger 56 of the lower chain appears at the exit of the bend 49. The shutter 49 retracts under the action of any suitable means (for example a time-controlled electromagnet) and the rod 58 of the roller 59 abuts on the finger 56. The movement of the chain 55 accompanies the descent of the pallet 57 along the first part 48 of the descending portion. During this travel, the pallet progressively rights itself again under the effect of the rollers 61 rolling over the raised edge of plate 43.

During the passage between the first part 48 and the second part 47 of the descending portion, the raising of the level allows the rod 58 to escape from finger 56, and the pallet freely piles up against the previously liberated pallets. During the reaction of the rocker 46, the first pallet, under the effect of gravity and of the pressure exerted on it by those which follow it, rights itself completely and, in display position abuts against the front of the box.

Like the shutter 51, the rocker 46 may be controlled by any suitable means such as a time-controlled electromagnet.

I claim:

1. A device for sequentially displaying images, comprising:

a plurality of strips;

a plurality of groups of pallets, said strips being mounted on said pallets independent of each other, said pallets being grouped together into groups in accordance with relative positions of said strips so that said strips from each of said groups form reconstituted images; and means for sequentially displaying said reconstituted images broken up into a form of said strips, said sequentially displaying means including a plurality of respective tracks each having a looped course, said tracks being arranged one above the other, said sequentially displaying means also including guide means for guiding said groups of said pallets respectively along said respective tracks so that said pallets remain independent of each other and follow said looped course of said respective tracks, said guide means being disposed on both sides of each of said pallets.

2. Device according to claim 1, wherein the looped course of the track for each pallet comprises a back portion for elevation of each pallet individually up to an upper level, a substantially horizontal portion in which the pallets pile up and exert a thrust on each other which tends to bring the first pallet of the row into a vertical display position, and an oblique portion in which the pallet just displayed is individually guided to a low level of the back portion.

3. Device according to claim 2, wherein the pallets are raised along the back portion by an elevator controlled by a connecting rod-crank assembly driven by the motor.

4. Device according to claim 3, wherein the elevator carries, for each group of pallets, a finger arranged obliquely along the same angle as the back portion of the corresponding track, an upper edge of said finger having an oblique bearing surface in an opposite direction.

5. Device according to any of claims 2 to 4, wherein in front of the tracks (9) a shutter is disposed which brings the pallets individually into display position and maintains the pallets said position for a determined length of time.

6. Device according to claim 1, further comprising means for piling up the pallets by gravity one behind the other in a row to exert a thrust on each other which in cooperation with a removable rocker tends to raise a first pallet of the row into a vertical position and to bring the first pallet into a display position after removal of the rocker.

7. Device according to claim 6, wherein the looped course has an elevation portion and a descent portion parallel to the elevation portion, further comprising means for entraining the pallets in the elevation portion and in the descent portion said entraining means having two chains with links carrying at regular intervals fingers directed outward.

* * * * *